US005363529A

United States Patent [19]

Fitjer

[11] Patent Number: 5,363,529

[45] Date of Patent: Nov. 15, 1994

[54] DENTAL BRUSH

[75] Inventor: Holger Fitjer, Ansbach, Germany

[73] Assignee: George Karl Geka-Brush GmbH, Bechhofen-Waizendorf, Germany

[21] Appl. No.: 65,263

[22] Filed: May 21, 1993

[30] Foreign Application Priority Data

May 22, 1992 [DE] Germany ..... 9206967[U]

[51] Int. Cl.[5] ..... A46B 3/18

[52] U.S. Cl. ..... 15/167.1; 15/206

[58] Field of Search ..... 15/167.1, 206; 132/218

[56] References Cited

U.S. PATENT DOCUMENTS 1,809,725 6/1931 Roe ..... 15/206
2,129,002 9/1938 Gold ..... 15/206
2,465,396 3/1949 Peterson et al. ..... 15/206

FOREIGN PATENT DOCUMENTS 725480 9/1942 Germany ..... 15/206
791497 3/1958 United Kingdom ..... 15/206
2085718 5/1982 United Kingdom ..... 15/206

*Primary Examiner*—David A. Scherbel
*Assistant Examiner*—Mark Spisich
*Attorney, Agent, or Firm*—Browdy and Neimark

[57] ABSTRACT

A dental brush comprises two intertwisted wire sections between which fibers for cleaning the teeth and tooth gaps are arrested by the twisting. To achieve an increased retaining force acting on the fibers, it is provided in such a dental brush that at least one of the wire sections has a fin extending in the longitudinal direction.

3 Claims, 1 Drawing Sheet

DENTAL BRUSH

FIELD OF THE INVENTION

The invention relates to a dental brush comprising two intertwisted wire sections between which fibers for cleaning the teeth and tooth gaps are arrested by the twisting.

BACKGROUND OF THE INVENTION

Dental brushes of the generic type have been known per se for a long time and are expressly recommended by dentists for intense dental care, in particular for cleaning the tooth gaps.

For penetration into the tooth gaps it is necessary for such brushes to have fibers of a comparatively small diameter and also wire sections of a small diameter. This, however, gives rise to the problem that the fibers cannot be sufficiently reliably arrested between the wire sections so that sometimes individual fibers come off, which the user will feel to be extraordinarily unpleasant especially when these fibers get stuck in the tooth gaps. In particular, this problem appears when such brushes are used in electrically operated cleaning devices working by oscillating and reciprocating rotation.

SUMMARY OF THE INVENTION

It is accordingly an object of the invention to embody a dental brush of the generic kind such that the retaining force exerted on the fibers between the twisted wire sections is increased without any substantial increase in production-technological and constructive expenditure.

In accordance with the invention this object is solved in that at least one of the wire sections has at least one fin extending in the longitudinal direction.

It is achieved by this fin that the pressure acting on the fibers and exercised by the twisted wire sections is increased as a result of the reduction of the pressure-exerting surface due to the point contact of an edge of the fin on the fibers. This leads directly to an increase in the retaining force, so that the fibers are very reliably arrested as compared to the rounded-off wires conventionally used.

In keeping with an object of the invention it can be provided that the at least one wire section has a sharp-edged, cornered cross-section. Consequently, the fin is formed by a corner of the cross-sectional configuration or by a plurality of such corners.

Advantageously, it may for instance be provided that the at least one wire section is triangular, quadrangular or polygonal in cross-section.

The importance of increasing the retaining force resides in particular in that a high retaining force is realized even with the very low wire thicknesses typically used in dental brushes, where the wire diameter is between 0.2 and 1.2 mm.

Finally and advantageously, provision can be made for a dental brush according to the invention to be provided with a retaining neck for insertion into an electrically operated tooth cleaning device.

Further details of the invention will become apparent from the ensuing description of preferred exemplary embodiments taken in conjunction with the drawing.

DESCRIPTION OF THE PREFERRED EMBODIMENTS

Figure 1:
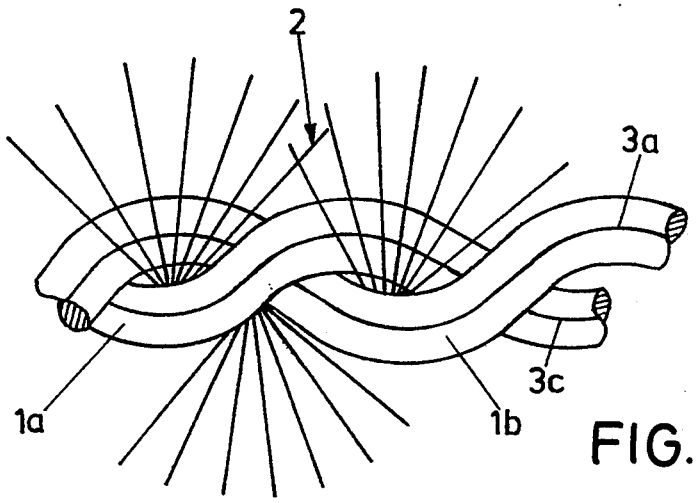
FIG. 1 is a diagrammatic, perspective illustration of a section of a dental brush according to the invention.

A dental brush illustrated in the drawing comprises two intertwisted wire sections 1*a*, 1*b*, between which fibers 2 are arrested by the twisting.

Figure 2:
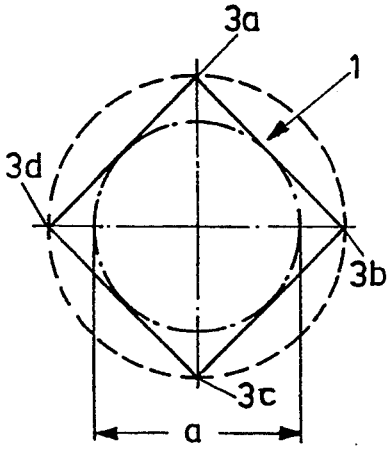
FIG. 2 is a cross-section through a wire section of quadratic cross-section.

The wire sections 1*a*, 1*b* illustrated in FIG. 1 have a quadratic cross-section as shown in FIG. 2. Correspondingly, the four longitudinally extending corners 3*a* to 3*d* form fins 3 acting at an increased pressure on the fibers 2, thus preventing the fibers 2 to be pulled out.

The fins 3 may however also be realised in that they are formed on the surface of a wire of an otherwise round diameter. In this case, the fins may be parallel as well as biased in relation to the longitudinal axis of the wire. Within the scope of the invention it is quite possible that the fins provided are not continuous but form a plurality of fin sections in a sort of a diagonal pattern.

Figure 3:
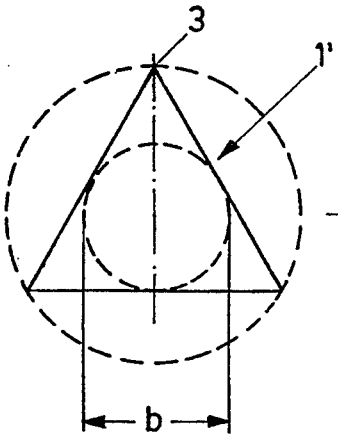
FIG. 3 is a cross-section through a wire section of triangular cross-section.
Figure 4:
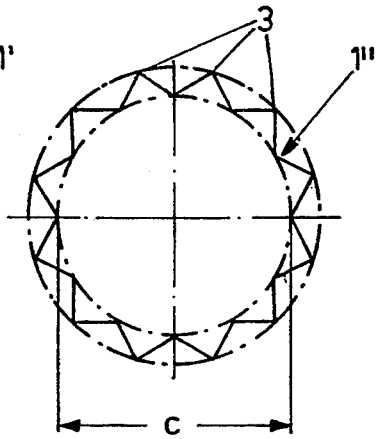
FIG. 4 is a cross-section through a wire section of polygonal cross-section.

FIG. 3 shows a further example of embodiment with the wire sections 1' having a triangular cross-section. FIG. 4 shows an example with wire sections 1'' of polygonal configuration. The outer corners of the polygons each form a fin 3 for arresting the fibers 2.

To specify the diameter of the wire sections illustrated in FIGS. 2 to 4 a circle is outlined within each polygonal cross-section, the circle diameter a, b and c, respectively, being used to characterize the wire diameter.

For example, dimensions of 0.21 mm, 0.51 mm and 0.71 mm may be used for the diameter a.

The diameter b may for instance be in the range of 0.15 mm, 0.36 mm or 0.5 mm.

0.26 mm, 0.6 mm or 0.8 mm are favorably provided for the diameter c.

The above-identified diameter dimensioning refers to commercially available wire configurations, the invention of course not being restricted to the use of these concrete diameters.

What is claimed is:

1. A dental brush comprising two intertwisted elongated wire sections, between which fibers for cleaning teeth and tooth gaps are arrested by the twisting, at least one of said two intertwisted wire sections having a polygonal cross section and a fin (3) formed by adjacent sides of said at least one of said two intertwined wire sections extending in a longitudinal direction of said at least one of the elongated wire sections, said fin having a sharp edge engaged to and arresting in point contact said fibers to prevent the fibers being pulled from between said two intertwisted wire sections, wherein a diameter of a circle drawn within and touching sides of said polygonal cross section is between 0.2 and 1.2 mm.

2. A dental brush according to claim 1, wherein a portion of said edge of said fin is angled to the longitudinal axis of said at least one of the wire sections.

3. A dental brush according to claim 1, wherein a portion of said edge of said fin is parallel in relation to the longitudinal axis of said at least one of the wire section.

* * * * *